US007647742B2

(12) United States Patent
Han

(10) Patent No.: US 7,647,742 B2
(45) Date of Patent: Jan. 19, 2010

(54) CONSTRUCTION METHOD FOR SRC STRUCTURED HIGH RISE BUILDING

(76) Inventor: Bong Kil Han, 2 Fl., 75-9, Sadang-Dong, Tongjak-ku, Seoul (KR) 156-090

( * ) Notice: Subject to any disclaimer, the term of this patent is extended or adjusted under 35 U.S.C. 154(b) by 552 days.

(21) Appl. No.: 10/511,714

(22) PCT Filed: Mar. 31, 2003

(86) PCT No.: PCT/KR03/00643

§ 371 (c)(1),
(2), (4) Date: Oct. 15, 2004

(87) PCT Pub. No.: WO03/089728

PCT Pub. Date: Oct. 30, 2003

(65) Prior Publication Data

US 2005/0115164 A1 Jun. 2, 2005

(30) Foreign Application Priority Data

Apr. 18, 2002 (KR) ..... 10-2002-0021093

(51) Int. Cl.
*E04B 1/00* (2006.01)
*E04B 5/18* (2006.01)

(52) U.S. Cl. ..... 52/741.1; 52/236.5; 52/252; 52/334; 52/295; 52/653.1

(58) Field of Classification Search ..... 52/432, 52/236.5, 251, 252, 259, 289, 334, 236.8, 52/253, 250, 236.6, 260, 414, 236.3, 234, 52/653.1, 236.7, 295, 296; 264/31, 33, 35
See application file for complete search history.

(56) References Cited

U.S. PATENT DOCUMENTS 872,954 A * 12/1907 Martin ..... 52/251

(Continued)

FOREIGN PATENT DOCUMENTS

JP 04-306335 10/1992

(Continued)

OTHER PUBLICATIONS

International Search Report for PCT/KR03/00643 dated Aug. 25, 2003.

*Primary Examiner*—Richard E Chilcot, Jr.
*Assistant Examiner*—Brent W Herring
(74) *Attorney, Agent, or Firm*—Norris McLaughlin & Marcus, PA

(57) ABSTRACT

A method for constructing a high rise building having a core and a residence space around the core, the method including (a) installing a steel-frame pillar on a shaft portion of the core; (b) connecting a girder to the steel-frame pillar, the girder includes an anchor-connecting member to which a steel-frame beam is connected, a portion of the anchor-connecting member being buried in a core wall; (a) assembling the steel-frame beam on the anchor-connecting member; (d) arranging reinforcing bars in a deck plate or a slab type mold installed on the steel-frame beam, and in the core wall; and (e) applying a slab concrete and a core concrete simultaneously or in this order. The quality of the core and slab structure is improved, while providing the construction safety and saving the construction costs.

4 Claims, 4 Drawing Sheets

U.S. PATENT DOCUMENTS 976,182 A * 11/1910 Jones ..... 52/252
1,045,520 A * 11/1912 Conzelman ..... 52/283
1,883,376 A * 10/1932 Meier et al. ..... 52/654.1
2,168,725 A * 8/1939 Whelan ..... 52/220.2
2,345,500 A * 3/1944 Petter ..... 52/73
2,675,895 A * 4/1954 Loewenstein ..... 52/236.3
2,698,973 A * 1/1955 Zeckendorf et al. ..... 52/185
2,943,716 A * 7/1960 Babcock ..... 52/653.1
3,251,167 A * 5/1966 Curran ..... 52/327
3,355,853 A * 12/1967 Wallace ..... 52/745.13
3,495,371 A * 2/1970 Mitchell, Jr. ..... 52/653.1
3,527,007 A * 9/1970 McManus ..... 52/327
3,640,039 A * 2/1972 McKee et al. ..... 52/281
3,846,944 A * 11/1974 Lambert ..... 52/236.3
3,938,294 A * 2/1976 Gaburri ..... 52/742.14
4,071,988 A * 2/1978 Bowes ..... 52/127.1
4,125,977 A * 11/1978 Michlovic ..... 52/220.4
4,231,148 A * 11/1980 Harding ..... 29/469
4,276,730 A * 7/1981 Lewis ..... 52/220.2
4,333,285 A * 6/1982 Koizumi et al. ..... 52/252
4,508,308 A * 4/1985 Rossin et al. ..... 249/19
4,918,897 A * 4/1990 Luedtke ..... 52/742.14
4,987,719 A * 1/1991 Goodson, Jr. ..... 52/742.14
5,048,257 A * 9/1991 Luedtke ..... 52/747.1
5,072,555 A * 12/1991 Geiger ..... 52/82
5,218,809 A * 6/1993 Baumann ..... 52/653.1
5,246,640 A * 9/1993 Bryant ..... 264/35
5,255,489 A * 10/1993 Matsumoto et al. ..... 52/745.17
5,289,665 A * 3/1994 Higgins ..... 52/655.1
5,305,572 A * 4/1994 Yee ..... 52/223.8
5,338,498 A * 8/1994 Lefebvre ..... 264/31
5,412,913 A * 5/1995 Daniels et al. ..... 52/79.13
5,509,243 A * 4/1996 Bettigole et al. ..... 52/334
5,528,866 A * 6/1996 Yulkowski ..... 52/79.12
5,660,017 A * 8/1997 Houghton ..... 52/655.1
6,266,938 B1 * 7/2001 Sheu et al. ..... 52/633
6,295,770 B1 * 10/2001 Sheu et al. ..... 52/167.1
6,298,630 B1 * 10/2001 VeRost et al. ..... 52/712
6,434,893 B1 * 8/2002 Quenzi ..... 52/126.1
6,735,914 B2 * 5/2004 Konopka ..... 52/309.11
6,802,169 B2 * 10/2004 Simmons ..... 52/648.1
6,922,960 B2 * 8/2005 Sataka ..... 52/236.3
7,007,431 B2 * 3/2006 Schubert ..... 52/263
7,240,459 B2 * 7/2007 Daudet et al. ..... 52/289
7,444,793 B2 * 11/2008 Raftery et al. ..... 52/741.14
2001/0003234 A1 * 6/2001 Van Doren ..... 52/251
2002/0095892 A1 * 7/2002 Johnson ..... 52/295
2008/0276550 A1 * 11/2008 Termohlen ..... 52/169.9

FOREIGN PATENT DOCUMENTS

JP 05-171684 7/1993
JP 06-264503 9/1994

* cited by examiner

CONSTRUCTION METHOD FOR SRC STRUCTURED HIGH RISE BUILDING

TECHNICAL FIELD

The present invention relates to a method for constructing a high rise building, which has residence spaces in and around a core, using a steel-framed reinforced concrete construction, and more particularly, to a method for constructing a high rise building structure that can improve quality of a slab and a core construction as well as construction efficiency and stability and reduces the construction costs by firstly mounting steel-frames for a core and a slab in advance and then applying reinforced concrete for the slab and the core.

BACKGROUND ARTS

Generally, a reinforced concrete (RC) construction, a steel-frame (S) construction, and a steel-framed reinforced concrete (SRC) construction are typically used to construct buildings. In recent years, as the buildings are large-sized and high-storied, a combination of three constructions has been widely used.

Furthermore, as the buildings are large-sized and high-storied, an earthquake-resistance and wind-resistance design becomes a major issue when constructing the buildings. Therefore, a core portion in which facilities such as an elevator, electric facility, system facility and a staircase are arranged is firstly constructed using the reinforced concrete construction, after which a main pillar portion for defining residence spaces is secondly constructed using the steel-frame construction.

FIGS. 1 and 2 show a conventional method for constructing a building having the SRC structure in which a core is constructed in advance.

In the drawings, the reference numeral 1 indicates a building core. The core 1 is constructed in advance using the RC construction considering the wind-resistance. Generally, a tower crane is installed in a core 1, and core dedicated facilities such as a hoist and a concrete distributor are installed an outer side of the core 1. A reinforcing bar 3 is arranged by the core-dedicated facilities, and a concrete 5 is applied to build the core in advance.

At this point, an anchor member 7 is installed when the concrete 5 is applied to prepare the construction of the steel-frame structure. The anchor member 7 includes a connecting member 7*a* buried in the concrete 5, an anchor plate 7*b* welded on the connecting member 7*a*, and a gusset plate 7*c* welded on the anchor plate 7*b*.

After the above, a steel-frame beam 9 is assembled on the gusset plate 7*c* using high tension bolts 7*c*, after which a slab 11 is built by installing a slab type mold, arranging reinforcing bars and applying concrete to a slab mold.

However, in the conventional method for constructing a building using the SRC construction in which the core is firstly build in advance, many dedicated facilities such as the hoist and the concrete distributor are required to arrange the reinforcing bar and apply the concrete. The dedicated facilities should be removed for the construction of the slab, complicating the construction process and increasing the construction costs.

In addition, since the advanced core has a small size than that of the residence space defined by the slab, which will be constructed after the core, it is difficult to manage the manpower, manual tool and equipments. Furthermore, the core and the slab should be constructed by separately applying concrete, a reinforcing bar connecting the core to the slab have to be installed on walls in advance, thereby further increasing the construction costs. The separate application of the concrete is apt to deteriorate the quality of the buildings.

In addition, since the working processes for the core and the slab should be done remotely in a vertical direction, the construction process is complicated and the quality control is difficult.

Particularly, since there is no approaching path to the anchor member for installing the steel-frame, a safety rail should be installed on each of the members to install the steel-frame beam. As a result, the construction period is longer, and the construction costs are inevitably higher.

SUMMARY OF THE INVENTION

Therefore, the present invention has been made in an effort to solve the above-described problems of the conventional arts.

It is an objective of the present invention to provide to a method for constructing a high rise building structure that can improve quality of a slab as well as construction efficiency and stability and reduces the construction costs by firstly mounting steel-frames for a core and a slab in advance and then secondly applying reinforced concretes for the slab and the core simultaneously or in this order.

To achieve the above objectives, the present invention provides a method for constructing a high rise building having a core and a residence space around the core, the method comprising the steps of (a) installing a steel-frame pillar on a shaft portion of the core; (b) installing a girder to the steel-frame pillar, the girder includes an anchor-connecting member to which a steel-frame beam is connected, a portion of the anchor-connecting member being buried in a core wall; (c) assembling the steel-frame beam on the anchor-connecting member; (d) arranging reinforcing bars in a deck plate or a slab type mold installed on the steel-frame beam, and in the core wall; and (e) applying a slab concrete and a core concrete simultaneously or in this order.

Preferably, the anchor-connecting member comprises a connecting member connected to the girder by welding or bolts, an anchor plate connected to the connecting member by welding or bolts, a gusset plate welded on the anchor plate, and a stud or shear connector extended from the anchor plate to the concrete wall and buried in the concrete.

Further preferably, the step (c) further comprises the steps of forming a slot hole on the anchor-connecting member and coupling a high tension bolt in the slot hole to be assembled on the steel-frame beam.

Still further preferably, plural sub-connecting members for supporting the deck plate or the slab type mold are installed on the girder installed between the steel-frame pillars, the sub-connecting members including a connecting member coupled to the girder and a supporting member coupled to one end of the connecting member.

EMBODIMENTS

The present invention will be described more in detail with reference to the accompanying drawings.

Figure 1:
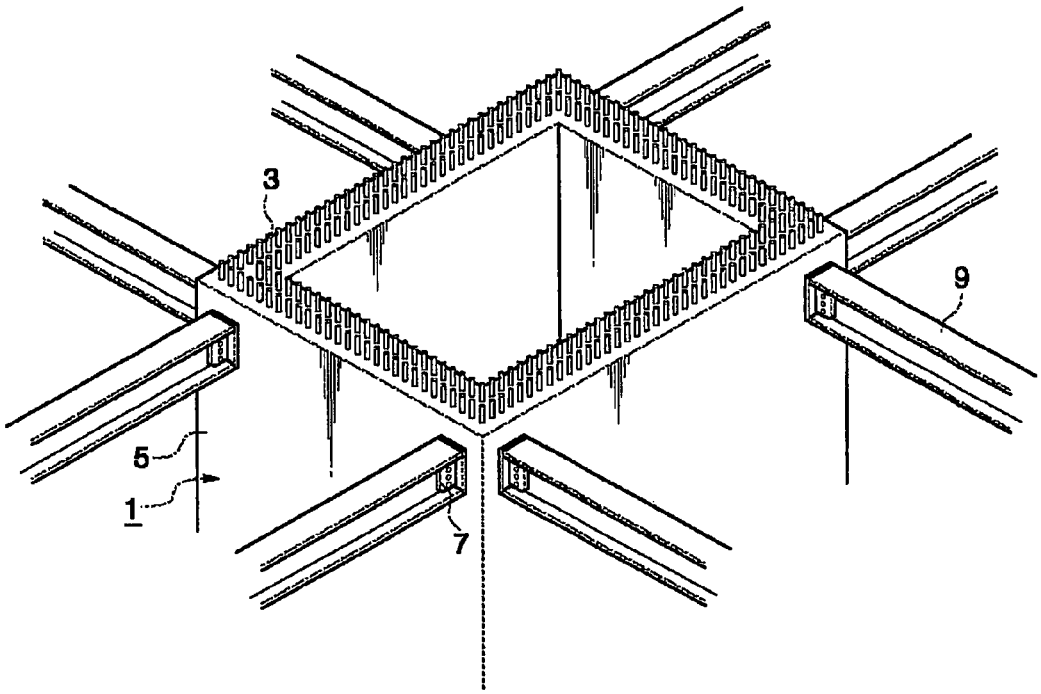
FIG. 1 is a perspective view illustrating a conventional constructing structure of a high-rise building.
Figure 2:
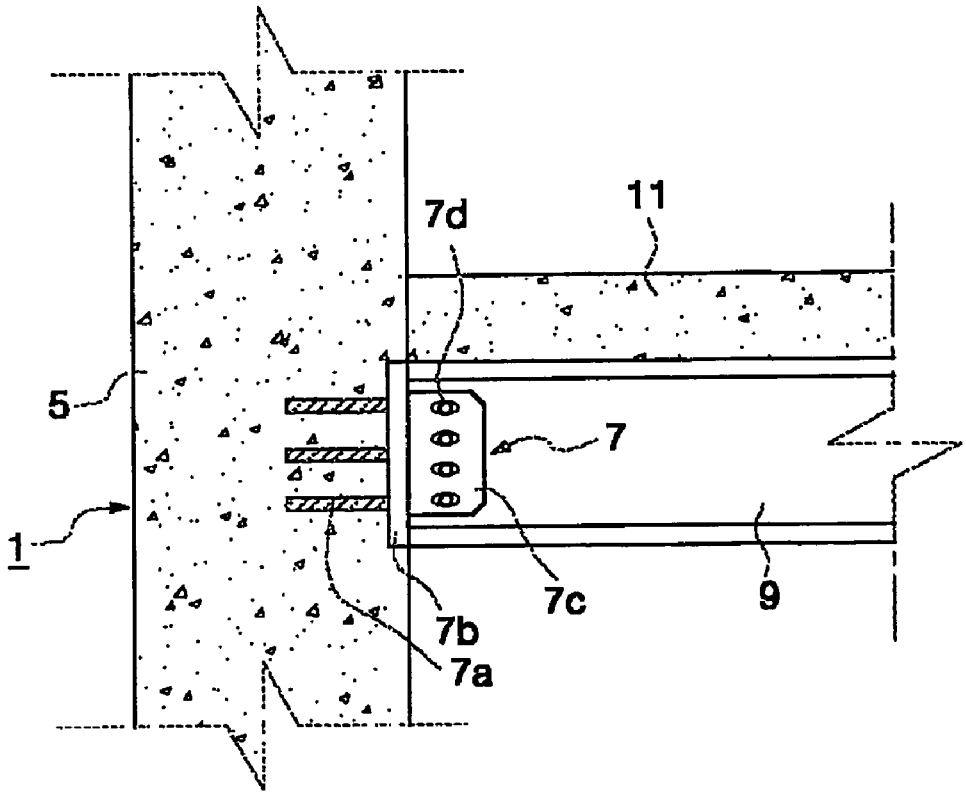
FIG. 2 is a sectional view of a conventional steel-frame beam structure.
Figure 3:
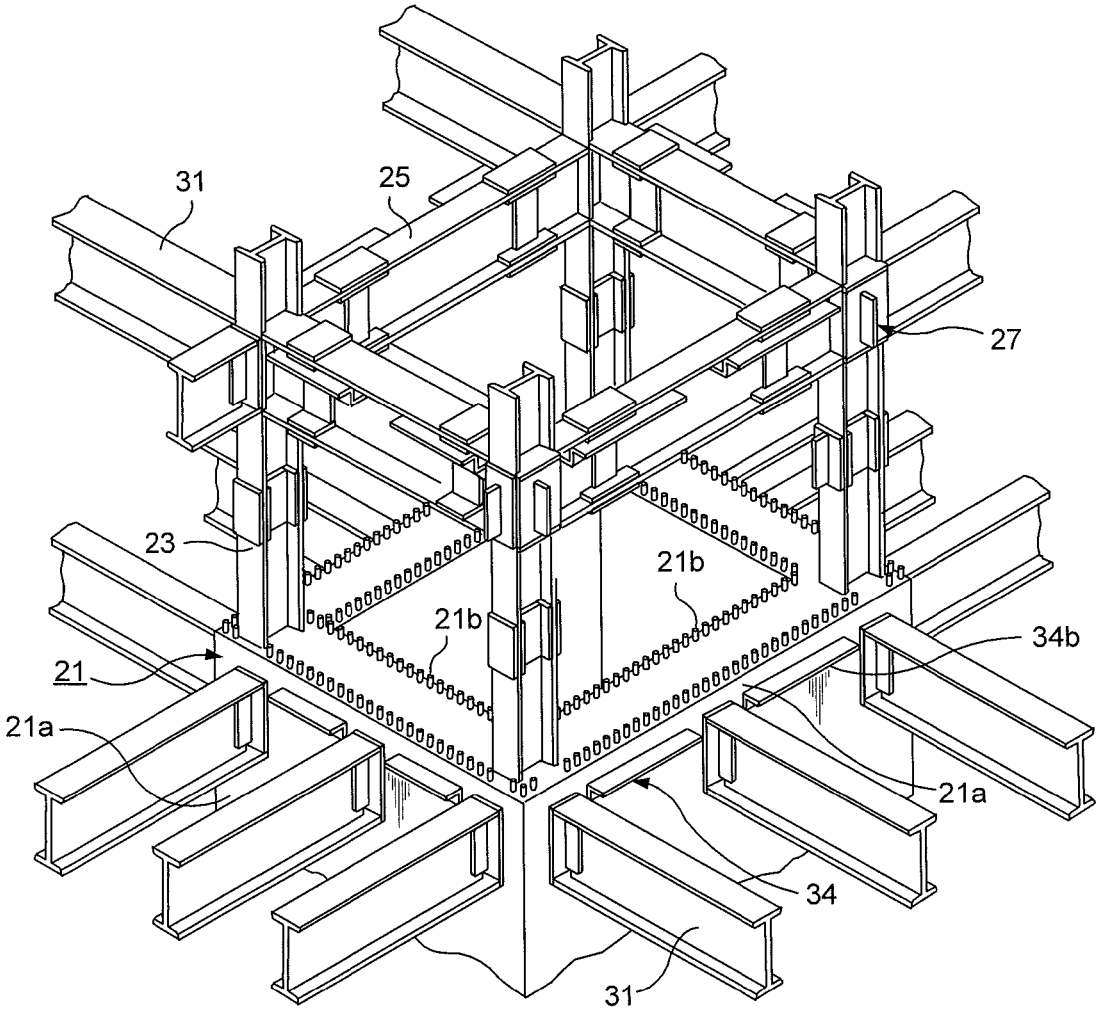
FIG. 3 is a perspective view illustrating a constructing structure of a high-rise building according to a preferred embodiment of the present invention.
Figure 4:
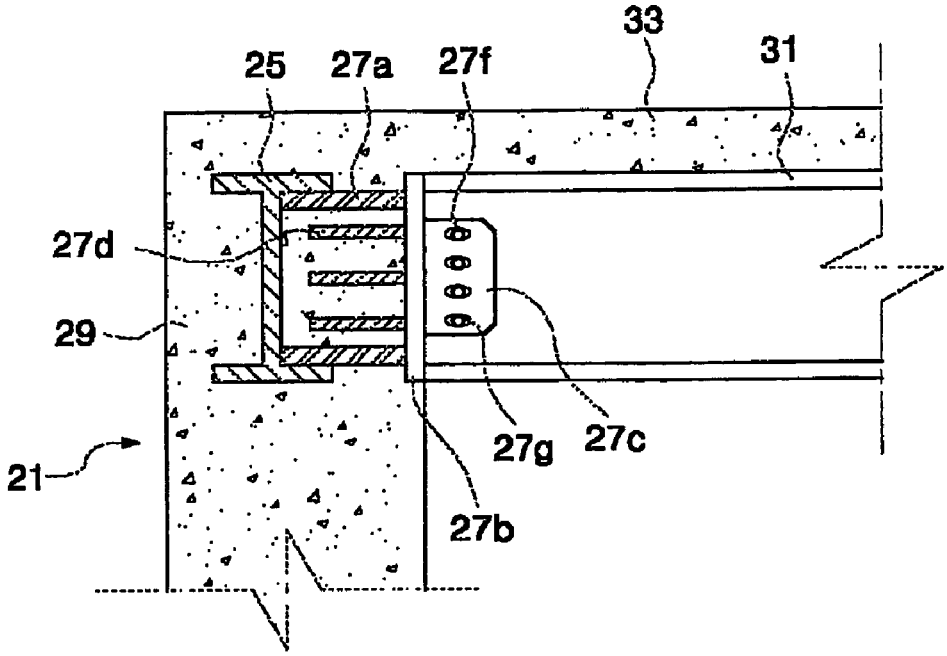
FIG. 4 is a sectional view of a girder and steel-frame beam structures according to a preferred embodiment of the present invention.
Figure 5:
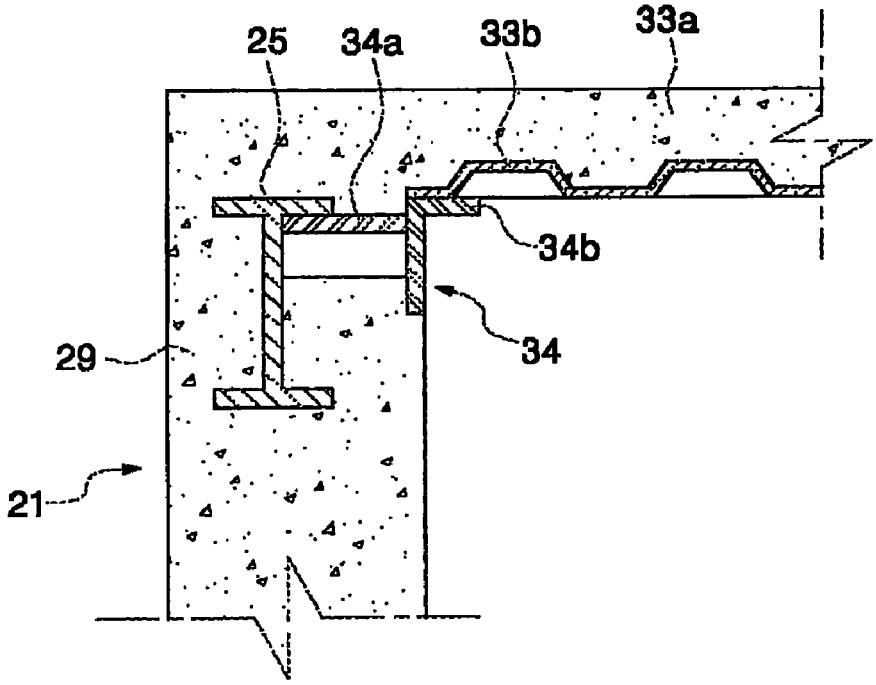
FIG. 5 is a sectional view of a slab installing structure according to a preferred embodiment of the present invention.

FIG. 3 shows a perspective view illustrating a constructing structure of a high rise building according to a preferred embodiment of the present invention, and FIG. 4 shows a sectional view of a girder and steel-frame beam structures according to a preferred embodiment of the present invention.

As shown in the drawings, a high rise building is constructed by firstly installing a steel-frame pillar 23 on a shaft portion of a core 21, and is then secondly a girder 25 and a steel-frame beam 31 are installed on the steel-frame pillar 23. Then, reinforcing bars for a slab 33 and a core 21 are arranged and concrete 29 is applied. At this point, after the reinforcing bars are arranged, the concrete may be firstly applied on the slab 33, and then may be applied on the core 21.

In the present invention, an anchor-connecting member 27 and a sub-connecting member 34 are integrated with the girder 25 by welding or bolts before the construction.

The anchor-connecting member 27 is installed on a core shaft portion to support the steel-frame beam 31. The anchor-connecting member 27 includes a connecting member 27*a* connected to the girder 25 by welding or bolts, an anchor plate 27*b* connected to the connecting member 27*a* by welding or bolts, a gusset plate 27*c* welded on the anchor plate 27*b*, and a stud or shear connector 27*d* extended from the anchor plate 27*b* to the inside of the concrete wall 21*a* and buried in the concrete.

The gusset plate 27*c* is provided with a slot hole 27*g* to compensate for the coupling error with the steel-frame beam 31.

The sub-connecting member 34 is provided to support the deck plate 33*b* for installing the slab 33. The sub-connecting member 34 includes a connecting member 34*a* connected to the girder 25 by welding or bolts and a supporting member 34*b* connected to one end of the connecting member 34*a* by welding or a bolt. A plurality of sub-connecting members 34 may be provided.

The construction method of a building according to the present invention will be described hereinafter with reference to the accompanying drawings.

The steel-frame pillar 23 is first installed on the shaft portion of the core 21, and a horizontal girder 25 is connected to the steel-frame pillar 23. Then, the steel-frame beam 31 is assembled on the girder 25 using the anchor-connecting member 27, thereby completing the steel-frame construction process.

At this point, a high tension bolt 27*f* coupled on the slot hole 27*g* formed on the gusset plate 27*c* of the anchor-connecting member 27 is strongly connected to the steel-frame beam 31. The high tensioned bolt 27*f* can be adjusted along the slot hole 27*g* to compensate for the assembling error.

After the above, a reinforcing bar 21*b* is mounted on a wall of the core 21, and the deck plate 33*b* or a slab type mold is installed on the steel-frame beam 31 and the girder 25 using the sub-connecting member 34, after which the reinforcing bar is installed in the deck plate 33*b* or the slab type mold.

Then, system forms are mounted on the shaft portion of the core 21, and euro-form or conventional form is installed on a living section, after which concretes 21*a* and 33*a* for a core wall and a slab are applied simultaneously. Alternatively, the concrete for the slab may be firstly applied and is then secondary the concrete for the core wall may be applied.

INDUSTRIAL APPLICABILITY

As described above, as steel-frame for the core and the slab are firstly constructed, and is then reinforcing bars are arranged in the core and slab sections, after which the concretes are applied to the slab and core sections simultaneously or in this order, the quality of the core and slab structures is improved, while providing the construction safety and saving the construction costs.

Furthermore, since the core and slab concrete constructions are performed after the steel-frame construction, the working balance of a finishing process such as an exterior wall curtain construction and an interior finishing construction can be controlled with the core and slab constructions, thereby reducing the construction period.

The invention claimed is:

1. A method for constructing a high rise building having a core and a residence space around the core, the method comprising the steps of:

(a) installing a steel-frame pillar on a shaft portion of the core;

(b) connecting a girder to the steel-frame pillar, the girder includes an anchor-connecting member to which a steel-frame beam is connected, a portion of the anchor-connecting member being buried in a wall of the core;

(c) assembling the steel-frame beam on the anchor-connecting member;

(d) installing a deck plate on the steel-frame beam, and mounting a reinforcing bar on the wall of the core; and (e) applying concrete for a slab and concrete for the wall of the core simultaneously or in this order wherein the anchor-connecting member comprises a connecting member connected to the girder by welding or bolts, an anchor plate connected to the connecting member by welding or bolts, a gusset plate welded on the anchor plate, and a stud or shear connector extended from the anchor plate to a concrete wall and buried in concrete.

2. The method of claim 1, further comprising the step of:

installing a sub-connecting member for supporting the deck plate on the girder between more than one steel-frame pillar, the sub-connecting member comprises a connecting member coupled to the girder and a supporting member coupled to one end of the connecting member.

3. The method of claim 2, wherein the deck plate is supported by the sub-connecting member and located adjacent to a top side of the sub-connecting member.

4. The method of claim 1, wherein the step (c) further comprises the steps of forming a slot hole on the anchor-connecting member and coupling a high tensioned bolt in the slot hole to be assembled on the steel-frame beam.

* * * * *